US009415781B2

(12) United States Patent
Hardin et al.

(10) Patent No.: US 9,415,781 B2
(45) Date of Patent: Aug. 16, 2016

(54) DUAL ENGINE LOCOMOTIVE

(75) Inventors: W. Jack Hardin, Metamora, IL (US); Walter E. Earleson, Morton, IL (US); Roy C. Fonseca, East Peoria, IL (US)

(73) Assignee: Progress Rail Services Corporation, Albertville, AL (US)

( * ) Notice: Subject to any disclaimer, the term of this patent is extended or adjusted under 35 U.S.C. 154(b) by 1372 days.

(21) Appl. No.: 12/644,000

(22) Filed: Dec. 21, 2009

(65) Prior Publication Data

US 2010/0170414 A1 Jul. 8, 2010

Related U.S. Application Data

(60) Provisional application No. 61/140,074, filed on Dec. 23, 2008.

(51) Int. Cl.
*B61C 17/00* (2006.01)
*B61C 17/04* (2006.01)

(52) U.S. Cl.
CPC ..... *B61C 17/04* (2013.01)

(58) Field of Classification Search
USPC ..... 105/26.05, 35, 49, 61, 62.1
See application file for complete search history.

(56) References Cited

U.S. PATENT DOCUMENTS

| | | | | |
|---|---|---|---|---|
| 5,129,328 | A | 7/1992 | Donnelly | |
| 6,308,639 | B1 * | 10/2001 | Donnelly et al. | 105/50 |
| D464,622 | S | 10/2002 | Donnelly | |
| 6,812,656 | B2 * | 11/2004 | Donnelly et al. | 318/66 |
| 6,984,946 | B2 | 1/2006 | Donnelly et al. | |
| 7,064,507 | B2 | 6/2006 | Donnelly et al. | |
| 7,084,602 | B2 | 8/2006 | Donnelly et al. | |
| 7,124,691 | B2 * | 10/2006 | Donnelly et al. | 105/26.05 |
| 7,304,445 | B2 * | 12/2007 | Donnelly | 318/108 |
| 7,309,929 | B2 * | 12/2007 | Donnelly et al. | 290/4 R |
| 7,349,797 | B2 | 3/2008 | Donnelly et al. | |
| 7,431,005 | B2 * | 10/2008 | Hawkins et al. | 123/179.4 |
| 7,467,830 | B2 | 12/2008 | Donnelly | |
| 7,507,500 | B2 | 3/2009 | Donnelly et al. | |
| 7,514,807 | B2 | 4/2009 | Donnelly et al. | |
| 7,518,254 | B2 * | 4/2009 | Donnelly et al. | 290/40 C |
| 7,565,867 | B2 * | 7/2009 | Donnelly et al. | 105/62.1 |
| 7,667,347 | B2 * | 2/2010 | Donnelly et al. | 307/10.1 |

(Continued)

FOREIGN PATENT DOCUMENTS

| | | |
|---|---|---|
| EP | 2015955 | 1/2009 |
| JP | 04007950 | 9/2007 |

(Continued)

*Primary Examiner* — Jason C Smith

(74) *Attorney, Agent, or Firm* — Finnegan Henderson, Farabow, Garrett & Dunner, LLP

(57) ABSTRACT

A diesel-electric locomotive has two separate engine systems, including a large engine system and a small engine system. The power output from the separate engine systems may be combined to power the locomotive's traction motors. When the locomotive requires low power output for propulsion, only the small engine system is used to power the traction motors. When the locomotive requires higher power output, only the large engine system is used to power the traction motors. When the locomotive requires maximum power output, the small and the large engine system may both be used and their power output combined to power the traction motors. Also, a unique control strategy maintains a smooth delivery of power to the traction motors in the event that one engine shuts down or starts as a result of a change in the commanded power output of the locomotive.

17 Claims, 4 Drawing Sheets

(56) References Cited

U.S. PATENT DOCUMENTS

| | | | | |
|---|---|---|---|---|
| 2005/0206331 | A1* | 9/2005 | Donnelly | 318/52 |
| 2005/0264245 | A1 | 12/2005 | Donnelly | |
| 2005/0279242 | A1 | 12/2005 | Maier et al. | |
| 2006/0012334 | A1 | 1/2006 | Watson | |
| 2006/0076171 | A1 | 4/2006 | Donnelly et al. | |
| 2006/0091832 | A1* | 5/2006 | Donnelly et al. | 318/108 |
| 2006/0266044 | A1 | 11/2006 | Donnelly et al. | |
| 2006/0266256 | A1* | 11/2006 | Donnelly et al. | 105/61 |
| 2007/0111089 | A1 | 5/2007 | Swan | |
| 2008/0048497 | A1 | 2/2008 | Donnelly et al. | |
| 2008/0051967 | A1 | 2/2008 | Tarnow et al. | |
| 2008/0053402 | A1 | 3/2008 | Hawkins et al. | |
| 2008/0082247 | A1* | 4/2008 | Hawkins et al. | 701/101 |
| 2008/0182466 | A1 | 7/2008 | Wegner-Donnelly et al. | |
| 2008/0246338 | A1* | 10/2008 | Donnelly et al. | 307/54 |
| 2008/0290825 | A1 | 11/2008 | St-Jacques et al. | |
| 2008/0296970 | A1* | 12/2008 | Donnelly et al. | 307/9.1 |
| 2009/0101041 | A1 | 4/2009 | Burns et al. | |
| 2010/0170414 | A1* | 7/2010 | Hardin et al. | 105/35 |

FOREIGN PATENT DOCUMENTS

| | | | |
|---|---|---|---|
| WO | 2004042890 | 5/2004 | |
| WO | 2007143850 | 12/2007 | |
| WO | 2008089571 | 7/2008 | |
| WO | WO 2008089571 A1 * | 7/2008 | B61C 7/04 |

* cited by examiner

FIG. 3

| NOTCH SETTINGS | TRACTIVE HP | SMALL ENGINE | LARGE ENGINE | MAX AMPERAGE | MAX VOLTAGE |
|---|---|---|---|---|---|
| 8 | 4000 | YES | YES | 9900 | 1400 |
| 7 | 3400 | | YES | 9000 | 1230 |
| 6 | 2600 | | YES | 7800 | 1110 |
| 5 | 1800 | | YES | 6600 | 1015 |
| 4 | 1300 | | YES | 5400 | 890 |
| 3 | 900 | | YES | 4200 | 770 |
| 2 | 400 | YES | | 3000 | 545 |
| 1 | 200 | YES | | 1500 | 385 |
| IDLE | 0 | YES | | | |
| DB | 0 | YES | | | |

DUAL ENGINE LOCOMOTIVE

This application claims priority to U.S. provisional patent application No. 61/140,074 filed Dec. 23, 2008.

TECHNICAL FIELD

The field of this invention is the application of multiple engines to run a machine, and more specifically the application of multiple engines to run a diesel-electric locomotive.

BACKGROUND

Diesel-electric locomotives traditionally employ a high power diesel internal combustion engine to rotate an electric generator, which in turn provides electric power to drive the locomotive's traction motors and to power other components. In a line haul locomotive, the need for accelerating and pulling many hundreds of tons of rolling stock and cargo up to high speeds with the traction motors requires a large amount of power. The diesel engine in a line haul locomotive often has a rated power output exceeding 4,000 brake horsepower (bhp).

Large diesel engines perform well in terms of emissions and fuel efficiency at or near the rated power output. But the duty cycle typically experienced by a line haul locomotive also requires the engine to idle for long periods of time or maintain low train speeds, which results in the diesel engine running at a power output much lower than its rated output, in addition to running at high power output when accelerating a large train of cargo. The large diesel engine is relatively less effective in terms of emissions and fuel efficiency at low power outputs. Considering this range of required power outputs—from running at or near the rated power while accelerating a train, to running at low power during idle—the large diesel engine is a compromise, delivering its best performance at high power outputs.

Recently several locomotive manufacturers in the U.S. have begun to commercialize new locomotives which are powered by multiple diesel engines. For instance, multi-engine "gen set" switcher locomotives developed by several competing manufacturers are being tested by railroads. These locomotives are called "gen set" locomotives because each engine and respective electric generator are mounted together on a separate frame as an independent power pack—similar to a generator set used in backup power or remote power applications—which is then individually mounted to the locomotive deck. The multi-engine "gen set" locomotives have been built with 2-4 separate, identical power packs. Having multiple engines allows the operation of just a single engine during idling and low power output. The relatively small, single engine operated during low power output can operate more efficiently than a very large diesel engine at that same power output. A low power output will be a much higher percentage of the rated power of a small engine than it would be for a very large engine, and efficiency is generally a function of the percentage of rated power output. When the locomotive requires high power output, all of the engines can be operated simultaneously to produce maximum power. Thus, with the application of multiple engines, it is possible to reach a new compromise for locomotive propulsion where power can be provided almost as effectively, in terms of emissions and fuel efficiency, at low power output as at high power output.

While these multi-engine "gen-set" locomotives are proving advantageous in many ways compared to traditional single engine locomotives, there are certain trade-offs. For example, the overall power density of the multi-engine "gen-set" locomotives is lower than an equivalent single engine locomotive. To date, the power density penalty has limited the application of the multi-engine idea to relatively low power locomotives like switchers or road switchers. Unless the power density can be improved, a high power multi-engine locomotive would likely be undesirably long.

In addition, at high power output, running three or four small engines in a multi-engine locomotive is not as efficient as running a single engine locomotive. So there is an efficiency penalty at high power outputs. A line haul locomotive typically runs at full power output more often than a switcher locomotive. For this additional reason, the multi-engine concept has been applied to date only to switcher locomotives.

This patent application describes a multi-engine locomotive configuration and operating method which minimizes these trade-offs, enabling an effective multi-engine configuration for a large locomotive like a line haul locomotive.

SUMMARY

A novel locomotive power configuration will comprise a large diesel engine and a small diesel engine. In contrast, multi-engine "gen-set" locomotives under development today have identically sized engines. Each engine will drive a separate traction electrical generator. The two traction electrical generators will produce electric power which is fed to the traction motors associated with the locomotive drive axles. Each engine may also drive separate companion electrical generators. The two companion electrical generators will produce electric power which can be used to power accessory loads like an air compressor, traction motor blowers, fuel pumps, and traction electrical generator excitation.

In locomotive operating conditions requiring low power output such as idle, dynamic braking, or propulsion in notches 1 and 2, only the small diesel engine will operate. The small diesel engine will be more efficient at handling low power loads than would the large diesel engine. In operating conditions requiring higher power output such as propulsion in notches 3 to 7, only the large diesel engine will operate. In operating conditions requiring the highest power output such as propulsion in notch 8, both the small and the large diesel engines will operate simultaneously to achieve a high combined power output.

An operating strategy and method ensures that the large and small engines operate effectively together. For instance, when only the small or the large engine is operating, the other of the small or the large engine can be kept warm and ready to operate with little delay by preheating and prelubing the engine. Still, it will require an amount of time before an engine can be started and provide the commanded power output. When the locomotive operator commands an increase or reduction in power output that will result in one of the engines starting or turning off, a unique power management strategy manages the power delivered by the two engines during this transition period. At notch 2, for example, the small engine will still have some remaining available power output that is unused. When the operator moves to notch 3, the large engine starts, but will not be ready to deliver significant power immediately. Before the large engine is available to contribute its scheduled share of the power, the small engine will increase to rated power, or higher if possible, to temporarily deliver as much immediate power as possible. After the large engine starts and gradually begins to contribute power, the small engine can be gradually reduced to low power output. This power management strategy helps ensure a smooth delivery of power to the propulsion system.

BRIEF DESCRIPTION OF THE DRAWINGS

FIG. 3 is a table illustrating a strategy for scheduling the power output of the two engines for different operating conditions of the locomotive in FIG. 1.

DETAILED DESCRIPTION

Figure 1:
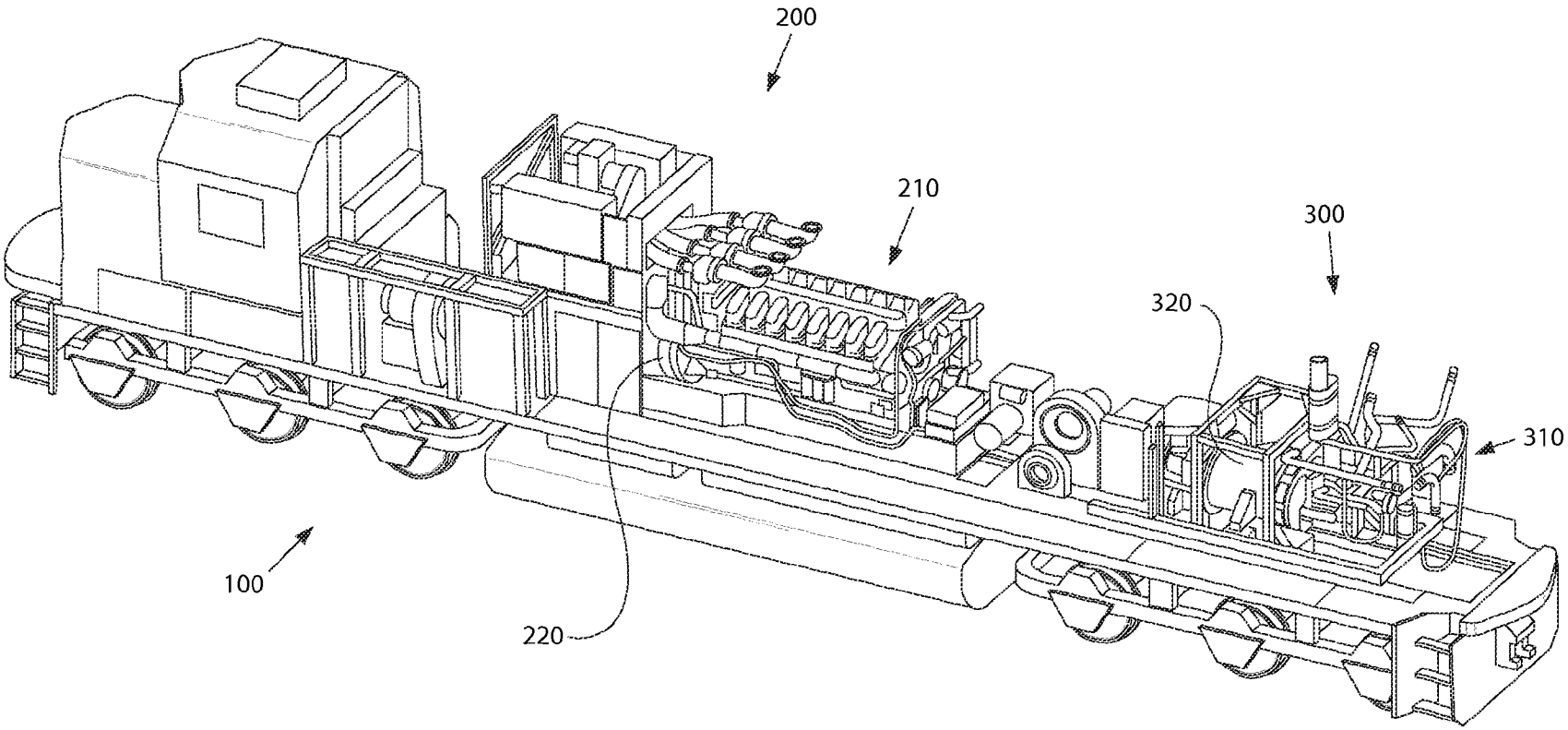
FIG. 1 is a illustration of a locomotive having a dual engine architecture according to the principles of the present invention. The locomotive includes a large diesel engine and a small diesel engine power module.

The following is a detailed description of exemplary embodiments of the invention. The exemplary embodiments described herein and illustrated in the drawing figures are intended to teach the principles of the invention, enabling those of ordinary skill in this art to make and use the invention in many different environments and for many different applications. The exemplary embodiments should not be considered as a limiting description of the scope of patent protection. The scope of patent protection shall be defined by the appended claims, and is intended to be broader than the specific exemplary embodiments described herein.

FIG. 1 depicts a locomotive 100 having an architecture and operating strategy according to the principles of the invention. The locomotive 100 has two separate and independent engine systems.

Large engine system 200 includes an engine 210 which may be a relatively large internal combustion diesel engine, such as a sixteen cylinder engine with a rated power output of around 3,600 bhp and, in one example, may have a range of rated output of between 3,000 and 4,200 bhp. Engine 210 drives a traction electrical generator 220. Traction electrical generator 220 may comprise an electrical alternator outputting DC electrical power. Engine 210 also drives a companion (auxiliary) electrical generator which may also comprise an electrical alternator outputting DC electrical power. Large engine system 200 includes typical components and accessories for running the engine 210 and the traction electrical generator 220, including, but not limited to, a fuel injection system, an air cleaning and turbocharging system, a jacket water cooling system and separate circuit aftercooler cooling system, an air starter and an electrical starter, an alternator excitation system, etc.

Small engine system 300 includes an engine 310 which may be a relatively small internal combustion diesel engine, such as a six cylinder engine with a rated power output of approximately 700 bhp and, in one example, 7 may have a range of rated power output of between 400 and 1,000 bhp. Engine 310 likewise drives a traction electrical generator 320, which may be an alternator with a DC electrical output, and a companion electrical generator which may be an alternator with a DC electrical output. Small engine system 300 also includes typical components and accessories for running the engine 310 and the traction electrical generator 320, including, but not limited to, a fuel injection system, an air cleaning and turbocharging system, a jacket water cooling system and air-to-air aftercooler cooling system, an air starter and an electrical starter, an alternator excitation system, etc.

As seen in FIG. 1, the large engine system 200 is placed near the center of the locomotive 100, generally in between the two sets of wheels or trucks. The small engine system 300 is placed near the rear end of the locomotive 199, i.e. the end opposite the cabin, and is generally above the rear wheels or trucks.

The two engines 210, 310 are each diesel internal combustion engines, as are commonly employed on locomotives today. However, it is possible that one or both of the engines 210, 310 could be another type of internal combustion engine such as a gasoline or natural gas engine, or possibly a gas turbine engine, and still be configured according to the principles of this invention.

Figure 2:
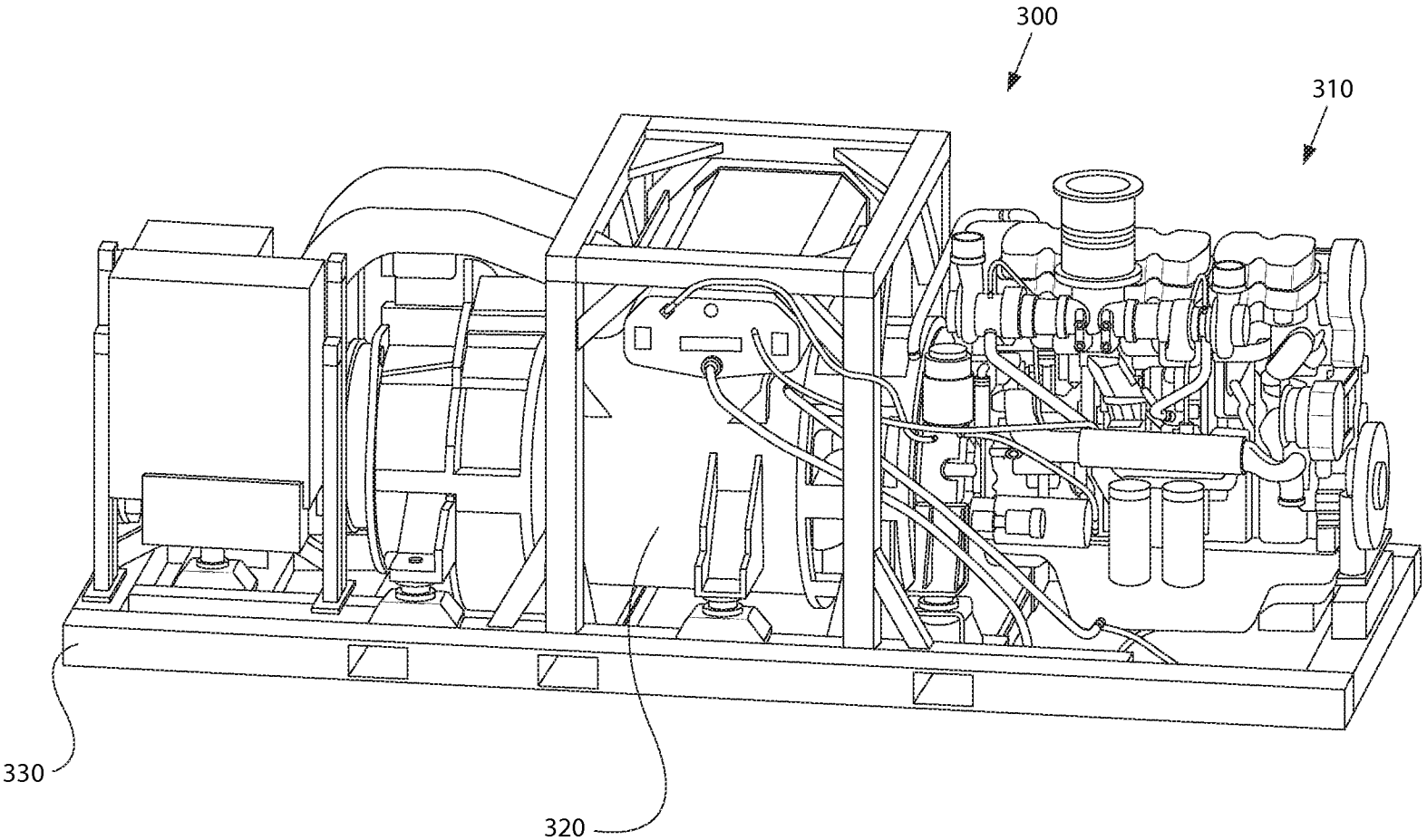
FIG. 2 is an illustration of the small engine power module in FIG. 1.

As illustrated in FIG. 2, small engine system 300 is a "gen set" style system as the engine 310, electrical generators, and other auxiliary components are all mounted on a separate frame 330 as a complete and separate power module, which is in turn supported on the locomotive deck. This permits simplified maintenance of small engine system 300 as the frame 330 may be detached from the locomotive deck and removed from the locomotive with all the components mounted on it, and serviced "off-chassis," or replaced with a spare module.

The electrical power output from the traction electrical generators 220, 320 may be combined on a common electrical bus which is in turn electrically connected to the locomotive's traction motors. The bus could be an AC bus or a DC bus, and likewise the fraction motors could be AC traction motors or DC traction motors. Switch gear could be positioned between the bus and the traction motors, as is known in the locomotive field.

FIG. 3 illustrates how a locomotive control system may alternately use one or the other of engine systems 200, 300, or both, to fulfill the power demand of the locomotive 100. In lower power output conditions, such as during idle, dynamic braking, and in notches 1 and 2, only the small engine system 300 will be used. The locomotive control system will regulate engine speed, fuel input, generator operation and other factors to produce the appropriate electrical power output from small engine system 300 in these conditions. In high power output conditions, such as in notches 3 to 7, only the large engine system 200 will be used. Likewise, the locomotive control system will regulate engine speed, fuel input, generator operation and other factors to produce the appropriate electrical power output from large engine system 200 in these conditions. In the highest power output conditions, such as in notch 8, both the large engine system 200 and the small engine system 300 may be used so that their combined power output can reach approximately 4,300 bhp to drive the locomotive traction motors in high acceleration or high speed line haul operation.

When either engine system 200 or 300 is inoperative, a lube oil pre-lubrication system may operate to continuously or from time to time lube the engine in preparation for starting. An engine warmer may also operate to heat the lube oil, the jacket cooling fluid, or both in preparation for starting. This will allow engine starts with minimal delays, and minimize the wear from starts. Alternatively, either engine 210, 310 could be scheduled to start on a periodic basis to lube and warm the engine (even when the engine is not needed to produce power for propulsion), or either engine could be started by the locomotive control system in response to detecting a low engine temperature or other factor.

Figure 4:
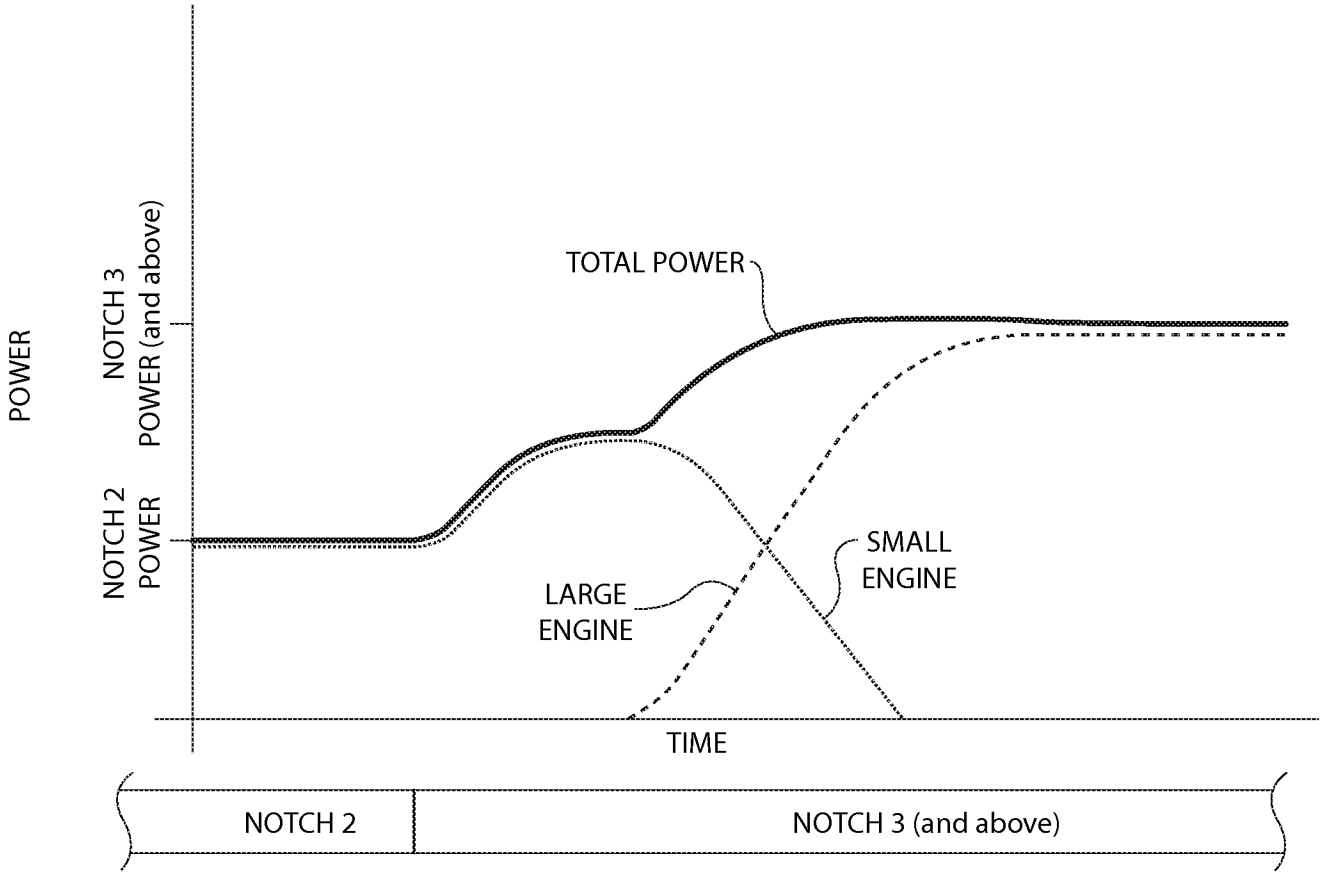
FIG. 4 is a chart illustrating a power management strategy for the locomotive in FIG. 1 during changes in commanded power output.

Still, if an operator commands a change in power output that requires the starting or stopping of either the large engine system 200 or the small engine system 300, there will be a time lag before the desired response can be achieved. For example, if the locomotive is in notch two and the operator moves to notch three, the schedule illustrated in FIG. 3 would require the small engine system 300 to turn off and the large engine system 200 to start and provide all of the power output corresponding to notch three. The engine 210 will require at least a few seconds to start and begin turning at the right speed before the traction electrical generator 220 can be excited and begin providing the desired electrical power output. This delay could be perceived as a lack of responsiveness on the part of the train crew. In order to make the locomotive more responsive to operator commands, the control system may temporarily increase the power output of the small engine system 300. If the small engine system 300 is operated in notch two below its rated power output, there is at least a small amount of remaining margin power which can be activated when the operator first moves to notch three. Or, alternatively, even if the small engine system 300 is already at or very close to its rated power output in notch two, the control system may be configured to allow the power output of the small engine system 300 to temporarily go above its rated power output. Operating for a few seconds above its rated power output should not adversely affect engine 310. This temporary increase in power output from the small engine system 300 is illustrated in FIG. 4 as a small rise in the Total Power and the Small Engine power curve that occurs after the switch from notch two to notch three. When the large engine system 200 eventually comes on line and begins contributing electrical power output to the fraction motors, the small engine system 300 may begin to power down in proportion to the increasing amount of power provided by the large engine system 200. When an engine is turned off in response to changing power demands from the operator, it may be advantageous to slowly ramp down the output power of that engine, as illustrated with respect to the small engine system 300 and the Small Engine power curve in FIG. 4, rather than abruptly turning off the engine and stopping the excitation of the traction electrical generator. By slowly ramping down the power output of the engine that is to be turned off, the total power output of the locomotive may be more consistently maintained and a smoother transition of and output of power will be perceived by the locomotive crew.

When either the small engine system 300 or the large engine system 200 is turned off because it is no longer needed according to the power output scheduling of the locomotive control system, the control system could maintain the respective engine running until it has cooled down to an appropriate temperature. For example, if the locomotive is in notch eight and the operator moves to notch seven, the schedule illustrated in FIG. 3 would require the small engine system 300 to turn off and the large engine system 200 to remain running and provide all of the power output corresponding to notch seven. But rather than immediately turning off the small engine system 300 after it is no longer contributing electrical power, the control system may maintain it in a running state for some period of time in order to ensure it cools down appropriately. The control system could be configured to shut down the small engine system 300 only after a minimum engine temperature threshold is crossed, or the control system could simply be configured to shut down the small engine system 300 after a fixed amount of time, such as five minutes.

One advantage of this system will be fuel economy and emissions. The small engine system 300 can be adapted to work efficiently and exhaust minimal harmful emissions for the locomotive's low power operating conditions. The large engine system 200 can be adapted to work efficiently and exhaust minimal harmful emissions for the locomotive's high power operating conditions.

Another advantage will be maintenance scheduling. The maintenance on the large engine 210 is in general more expensive than maintenance on the small engine 310. Because the small engine 310 will absorb a significant amount of the duty cycle time (how much depends on how the locomotive is used), the large engine 210 runs less frequently, and will require less maintenance, allowing more time between scheduled maintenance events and overhauls. In general, this should contribute to increasing the operational availability of the locomotive 100, and reduce the amount of expensive maintenance service work and repair parts needed for engine 210.

INDUSTRIAL APPLICABILITY

The foregoing principles of a dual engine architecture and control strategy for a machine may find industrial applicability in running industrial equipment or mobile equipment such as a locomotive.

We claim:

1. A method of operating a locomotive comprising:
providing a small engine system including a small engine having a maximum rated power output of 1,000 brake horsepower (bhp);
providing a large engine system including a large engine having a minimum rated power output of 3,000 bhp;
commanding low power output of the locomotive for propulsion;
delivering electrical power to the locomotive for propulsion from the small engine system while the large engine system is turned off;
commanding higher power output of the locomotive for propulsion;
delivering electrical power to the locomotive for propulsion from the large engine system while the small engine system is turned off;
commanding a highest power output of the locomotive for propulsion; and
delivering electrical power to the locomotive for propulsion simultaneously from the large engine system and the small engine system.

2. A method according to claim 1 wherein:
the small engine system further includes a first traction electrical generator;
the large engine system further includes a second traction electrical generator;
the small engine is a small diesel engine; and
the large engine is a large diesel engine.

3. A method according to claim 2 wherein:
the small diesel engine has a rated power output of between 400 and 1,000 brake horsepower (bhp); and
the large diesel engine has a rated power output of between 3,000 and 4,200 bhp.

4. A method according to claim 3 wherein the components of the small engine system are mounted to a separate frame, which is in turn mounted to the locomotive deck.

5. A method according to claim 3 wherein the large engine system is mounted near a middle of the locomotive and the small engine system is mounted near a rear end of the locomotive.

6. A method according to claim 1 further comprising:
temporarily increasing the power output of either the small engine system or the large engine system in response to either commanding the higher power output or the highest power output.

7. A method according to claim 1 further comprising:

when the commanded power output for locomotive propulsion is increased, temporarily increasing the power output of the large engine system or the small engine system until the other of the large engine system or the small engine system begins to output electrical power for propulsion.

8. A method according to claim 7 wherein:

the small engine system further includes a first traction electrical generator;

the large engine system further includes a second traction electrical generator;

the small engine is a small diesel engine; and the large engine is a large diesel engine.

9. A method according to claim 8 wherein:

the small diesel engine has a rated power output of between 400 and 1,000 brake horsepower (bhp); and the large diesel engine has a rated power output of between 3,000 and 4,200 bhp.

10. A method according to claim 9 wherein the components of the small engine system are mounted to a separate frame, which is in turn mounted to the locomotive deck.

11. A method of operating a locomotive comprising:

providing a first engine system, the first engine system including a low horsepower small diesel engine having a maximum rated power output of 1,000 brake horsepower (bhp) and a first traction electrical generator;

providing a second engine system, the second engine system including a high horsepower large diesel engine having a minimum rated power output of 3,000 bhp and a second traction electrical generator;

commanding a first power output of the locomotive for propulsion;

delivering electrical power to the locomotive for propulsion from the first engine system while the second engine system is turned off in order to fulfill the command for the first power output;

commanding a second power output of the locomotive for propulsion which is more than the first power output; and delivering electrical power to the locomotive for propulsion from the second engine system while the first engine system is turned off in order to fulfill the command for the second power output.

12. A method according to claim 11 further including:

commanding a third power output of the locomotive for propulsion which is more than the second power output; and delivering electrical power to the locomotive for propulsion simultaneously from the first engine system and the second engine system in order to fulfill the command for the third power output.

13. A locomotive comprising:

a first engine system including a first engine with a rated power output of between 400 and 1,000 bhp and a first traction electrical generator;

a second engine system including a second engine with a rated power output of between 3000 and 4,200 bhp and a second traction electrical generator;

a plurality of traction motors electrically connected to the first traction electrical generator and the second traction electrical generator; and a control system for controlling operation of the first engine and the second engine to drive the locomotive.

14. The locomotive of claim 13 wherein the first engine and the second engine are both internal combustion diesel engines.

15. The locomotive of claim 13 wherein the control system is configured to operate the first engine and the second engine in a sequential manner until a maximum amount of power is required.

16. The locomotive of claim 13 wherein the components of the first engine system are mounted to a separate frame, which is in turn mounted to the locomotive deck.

17. The locomotive of claim 13 wherein the second engine system is mounted near a middle of the locomotive and the first engine system is mounted near a rear end of the locomotive.

* * * * *